US005563407A

United States Patent [19]

Yamagishi

[11] Patent Number: 5,563,407

[45] Date of Patent: Oct. 8, 1996

[54] X-RAY IMAGE INTENSIFIER TUBE WITH AN ION PUMP TO MAINTAIN A HIGH VACUUM IN THE TUBE

[75] Inventor: Shirofumi Yamagishi, Ootawara, Japan

[73] Assignee: Kabushiki Kaisha Toshiba, Kawasaki, Japan

[21] Appl. No.: 308,934

[22] Filed: Sep. 20, 1994

[30] Foreign Application Priority Data

Sep. 20, 1993 [JP] Japan ..... 5-233219
Aug. 17, 1994 [JP] Japan ..... 6-192963

[51] Int. Cl.[6] ..... H01J 40/14

[52] U.S. Cl. ..... 250/214 UT; 313/7

[58] Field of Search ..... 250/207, 214 UT; 313/7, 382, 529, 537

[56] References Cited

U.S. PATENT DOCUMENTS 3,596,123 7/1971 Levin ..... 313/7
3,631,280 12/1971 Levin ..... 313/7
3,675,027 7/1972 Tsuda et al. ..... 250/214 VT
4,334,829 6/1982 Harbaugh ..... 417/49
5,194,726 3/1993 Jonkman ..... 250/214 VT

FOREIGN PATENT DOCUMENTS 63-86230 4/1988 Japan .
4-98732 3/1992 Japan .

*Primary Examiner*—Edward P. Westin
*Assistant Examiner*—Stephen Calogero
*Attorney, Agent, or Firm*—Cushman Darby & Cushman, L.L.P.

[57] ABSTRACT

An X-ray image intensifier incorporates a pair of opposed electrodes and an ion pump within a vacuum vessel. The ion pump supplies a magnetic field to a space between the opposed electrodes. At least one of the opposed electrodes is connected to focusing electrodes in the vacuum vessel. With this structure, the vacuum vessel can be maintained in a high vacuum for a long period of time.

12 Claims, 7 Drawing Sheets

X-RAY IMAGE INTENSIFIER TUBE WITH AN ION PUMP TO MAINTAIN A HIGH VACUUM IN THE TUBE

BACKGROUND OF THE INVENTION

1. Field of the Invention

The present invention relates to an X-ray image intensifier for converting an X-ray image to an optical image.

2. Description of the Related Art

An X-ray image intensifier is commonly used for medical or industrial purposes, and widely used for diagnosis or non-destructive inspection. A conventional X-ray image intensifier, such as that shown generally in FIG. 1, has an X-ray input window 11 and a vacuum vessel 12 having a glass barrel. An X-ray input screen 13, for emitting electrons in accordance with an input X-ray, is formed on the X-ray input window 11. The input screen 13, which in general has a fluorescent material and a photocathode, serves as a cathode of the X-ray image intensifier. On the opposite side of the input screen in the vacuum vessel 12 is formed an output screen 14, having a fluorescent material layer which emits light upon collision of electrons. A plurality of focusing electrodes 15 and 16 are arranged at predetermined portions in the vacuum vessel for forming an electrostatic electron lens and an accelerating anode 18 is arranged near the output screen.

When the X-ray image intensifier is operated, an operating power source (not shown) supplies potentials to the above elements: for example, a ground potential to the input screen 13, +300 V to a first focusing electrode 15, +1.7 kV to a second focusing electrode, and +30 kV to the output screen 14 and the anode 18. As a result, an X-ray emitted from an X-ray generator (not shown) is input to the input screen through an object and an X-ray image of the object is converted to a fluorescent image, which is further converted to an electronic image by the photocathode. The electronic image is accelerated and focused by an electronic lens system constituted by the focusing electrodes and the anode. The focused image, causing the fluorescent material layer to emit, is converted to a visible image having an increased conversion factor and output from the image intensifier.

When the X-ray image intensifier is used in a state where a very small amount of X-ray is input, a relatively small number of electrons are generated from the input screen and the amount of gas generated in the vacuum vessel is also small. It is therefore possible to maintain the vessel in a high vacuum for a long period of time merely by incorporating a predetermined amount of getters in the vessel, so that a stable operation can be obtained.

However, when the X-ray image intensifier is exposed to a relatively large amount of X-ray, as in a non-destructive inspection, a large amount of electrons are generated from the input screen and a large amount of gas is generated from the electrodes in the vessel, the output screen, the other elements in the vessel, and the vacuum vessel itself. As a result, the electron emitting performance of the input screen may be degraded or an abnormal discharge may occur in the vessel.

SUMMARY OF THE INVENTION

An object of the present invention to provide an X-ray intensifier wherein a vacuum vessel can be maintained in a high vacuum for a long period of time.

According to the present invention, there is provided an X-ray image intensifier having a vacuum vessel which incorporates an ion pump constituted by a pair of electrodes opposed to each other and an element for applying a magnetic field across the opposed electrodes, at least one of the opposed electrodes of the ion pump electrically connected to a focusing electrode in the vacuum vessel.

In the X-ray image intensifier of the present invention, the ion pump incorporated in the vacuum vessel is operated as soon as the image intensifier starts operating, and absorbs gas generated in the vessel. Hence, even when the image intensifier is operated in a state where a relatively large amount of X-ray is to be input to the input screen, the vessel is kept in a high vacuum and discharge is suppressed, so that a stable operation can be maintained. In addition, since terminals for applying a voltage to the ion pump are reduced, the structure can be simplified and the image intensifier can be assembled easily.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
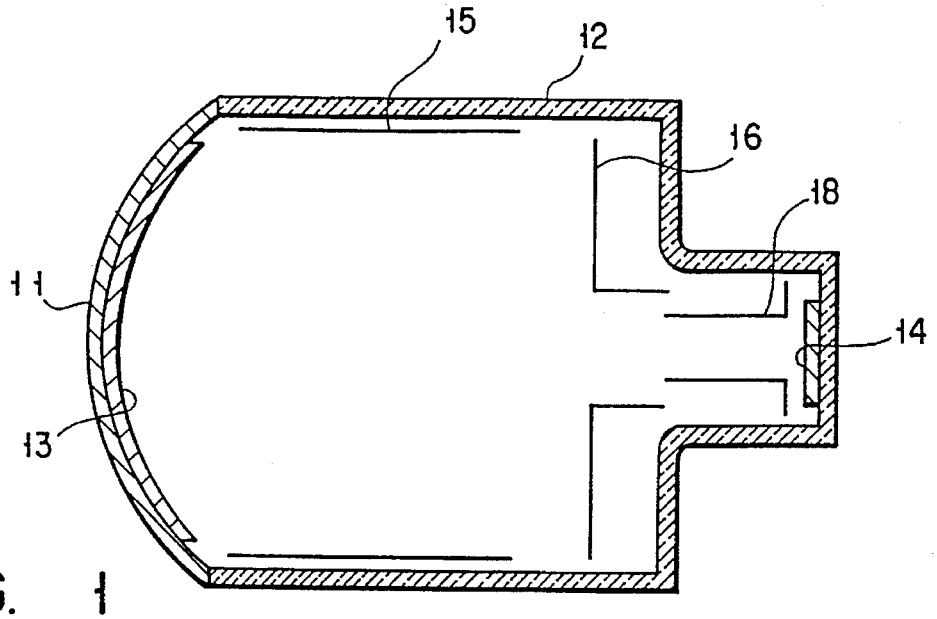
FIG. 1 (PRIOR ART)
FIG. 1 is a cross-sectional view schematically showing a conventional X-ray image intensifier.

Embodiments of an X-ray image intensifier of the present invention will be described with reference to the accompanying drawings. In the following, the same portions are identified with the same reference numerals.

Figure 2:
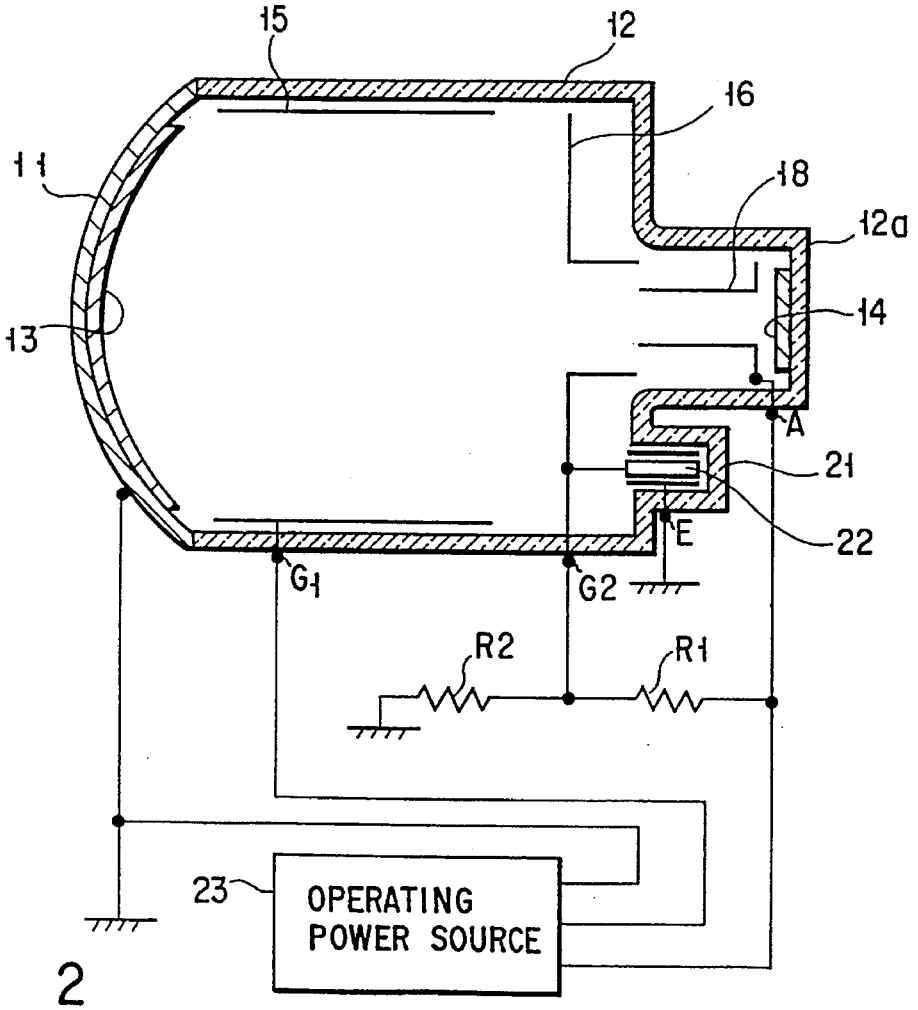
FIG. 2 is a cross-sectional view schematically showing an X-ray image intensifier according to an embodiment of the present invention.
Figure 3:
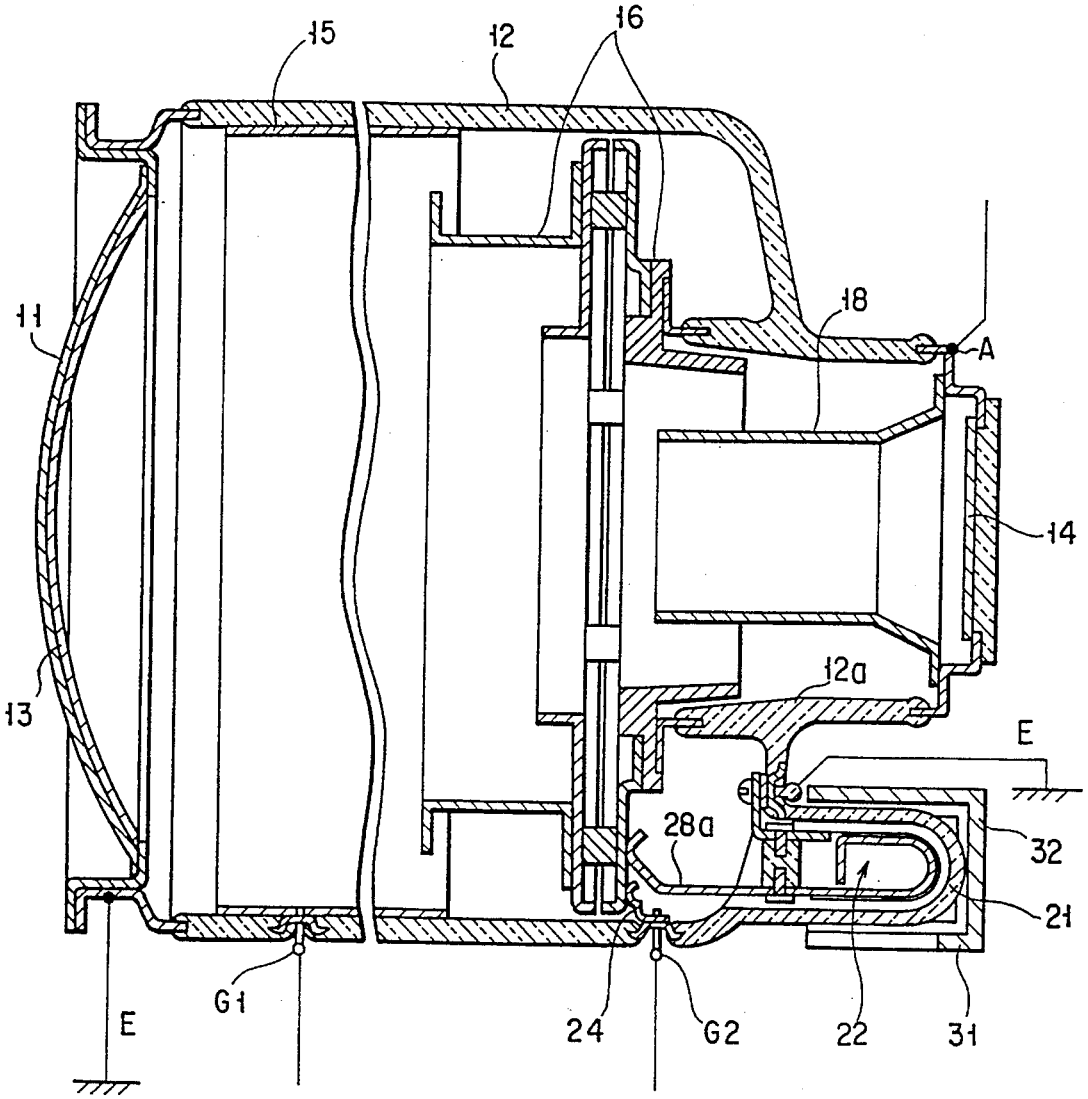
FIG. 3 is an enlarged cross-sectional view of the X-ray image intensifier shown in FIG. 2.

FIGS. 2 to 7 show an embodiment of the X-ray image intensifier of the present invention. As shown in FIG. 2, a convex X-ray input window 11, through which an X ray is input, is part of a vacuum vessel or envelope 12. The X-ray input window is formed of a thin metal plate of, e.g., aluminum, and adheres air-tightly to a glass barrel portion of the vacuum vessel 12. An X-ray input screen 13, for converting an X ray into light rays, which is further converted to electrons, is formed on an inner surface of the X-ray input window 11. An output screen 14, for receiving the electrons and converting them to a visible image, is formed in the vacuum vessel so as to oppose to the input screen 13. A first cylindrical focusing electrode 15 and a second focusing electrode 16 are formed in the vacuum vessel. An accelerating anode 18 for accelerating electrons is also formed in the vacuum vessel, near the output screen 14. The input screen 13, these electrodes and the accelerating anodes constitute an electrostatic electronic lens system for focusing electrons on a predetermined position. The output screen 14 may be of such a type as a phosphor screen which produces an optical image by electrons input thereto, or of such a type as a CCD area sensor which directly or indirectly produces an electric image signal.

A projecting tube section 21 made of glass is formed integral with the vacuum vessel, so as to be parallel with the axis of the vessel, at a portion of an outer side of an output side cylinder section 12*a* made of glass, in which the output screen and the accelerating anode 18 are arranged. An ion pump 22 is arranged inside the projecting tube section 21. As will be described later, the ion pump 22 is a vacuum pump in which a pair of electrodes are opposed to each other and a magnetic field is applied across the opposed electrodes in order to absorb gas. In general, a DC voltage of one to several kV is applied across the pair of opposed electrodes. In this embodiment, one of the opposed electrodes is electrically connected to the second focusing electrode 16 in the vessel, and the other of the opposed electrodes is grounded.

The X-ray input window 11 and the input screen 13 are grounded. The focusing electrodes 15 and 16 and the accelerating anode 18 are connected to an operation power source 23 so that a predetermined operation voltage can be applied thereto. More specifically, a high voltage of about 30 kV, is generated by the operating power source 23 and applied to the anode 18 and potential-dividing resistors R1 and R2 connected in series. A node between the potential dividing resistors R1 and R2 is connected to the second electrode 16. One of the opposed electrodes of the ion pump 22 is directly connected to the second focusing electrode 16 in the vessel, and the other is grounded. The second focusing electrode 16 and the ion pump 22 are thus operated with the same voltage.

With the above structure, the operation voltage, applied to the second focusing electrode 16, is directly applied to the opposed electrodes of the ion pump 22 incorporated in the vacuum vessel upon operation of the X-ray image intensifier, with the result that internal gas is ionized and absorbed by the ion pump 22.

Figure 4:
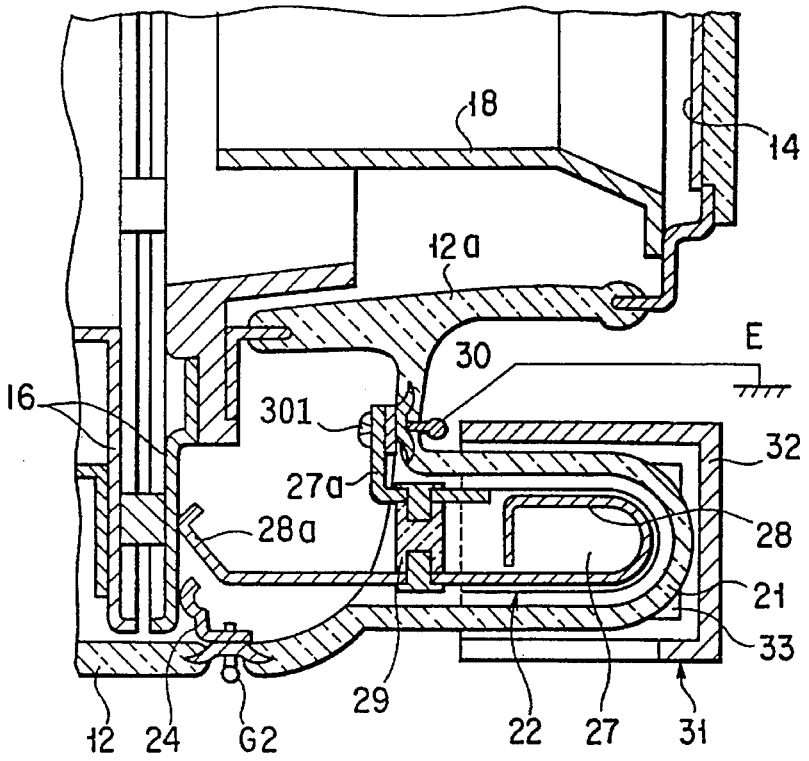
FIG. 4 is an enlarged view showing part of the X-ray image intensifier shown in FIG. 3.

Concrete structures of characteristic portions of the X-ray image intensifier will be described with reference to FIGS. 3 to 7. The first focusing electrode 15 is formed of a conductive film coated on an inner surface of the glass barrel portion of the vacuum vessel 12. The operation voltage is applied to the first focusing electrode 15 through a through terminal G1. The second focusing electrode 16 is formed mainly of three cylindrical electrodes, which are electrically short-circuited in the vessel, as shown in FIG. 4. The operation voltage is applied to the second focusing electrode 16 through a through terminal G2 and a spring 24.

Figure 6:
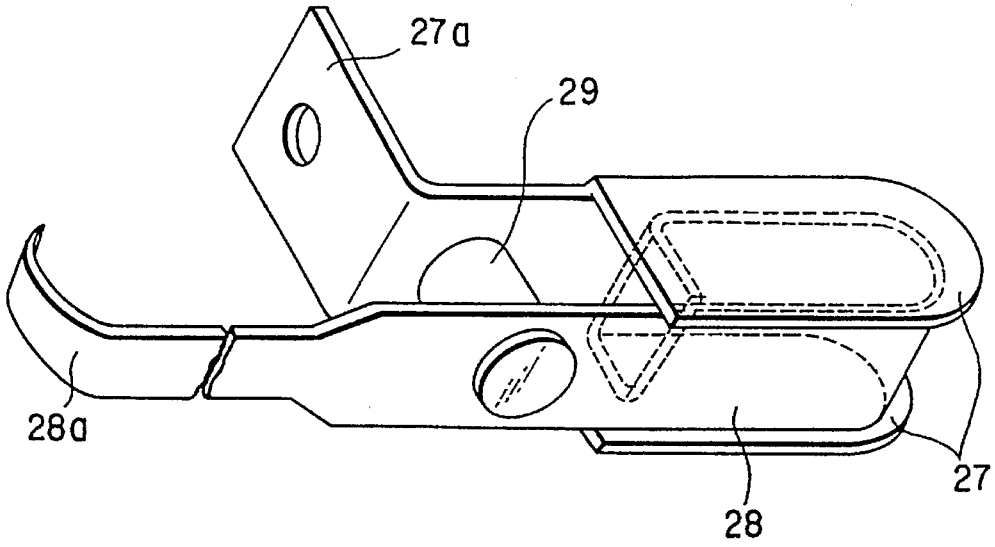
FIG. 6 is an enlarged perspective view showing an electrode structure of an ion pump shown in FIG. 3.
Figure 7:
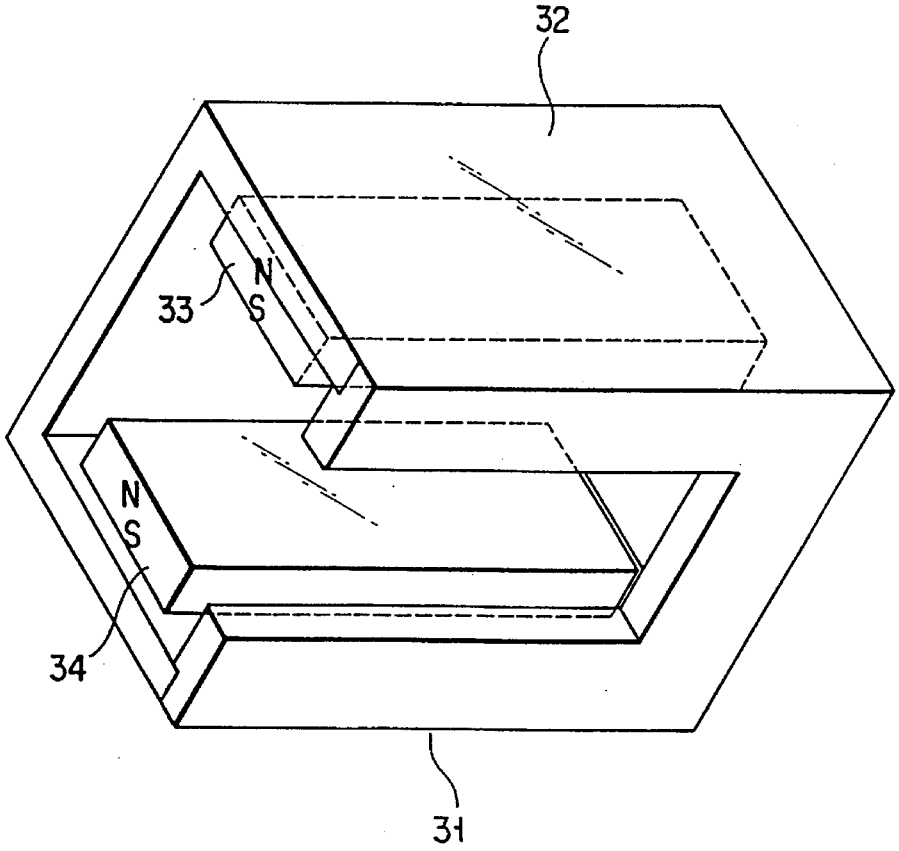
FIG. 7 is an enlarged perspective view showing a magnetic device of the ion pump shown in FIG. 3.

The ion pump 22 incorporated in the projecting glass tube 21 has a titanium (Ti) cathode 27 comprised of a pair of plates opposed to each other with a space provided therebetween and an ion pump anode 28 arranged in the space. As shown in FIG. 6, the ion pump anode 28, having an O shape, is made of stainless steel. The electrodes 27 and 28 are electrically insulated from each other by means of a ceramic insulating spacer 29 but are mechanically integral with each other. The cathode 27 has an L-shaped extended portion 27*a*, which is mechanically fixed to a through terminal 30 by means of a screw 301. The through terminal 30 is inserted through the glass cylinder section 12*a* surrounding the accelerating anode 18. The ion pump is thus mechanically held by the through terminal 30 and the cathode 27 is kept at a ground potential E via the through terminal 30. The ion pump anode 28 has an end portion 28*a* extended from the portion fixed to the insulating spacer 29 and brought into contact with a portion of the second focusing electrode 16. With this structure, the voltage of the second focusing electrode 16 is directly supplied to the ion pump anode 28 in the vessel.

Figure 5:
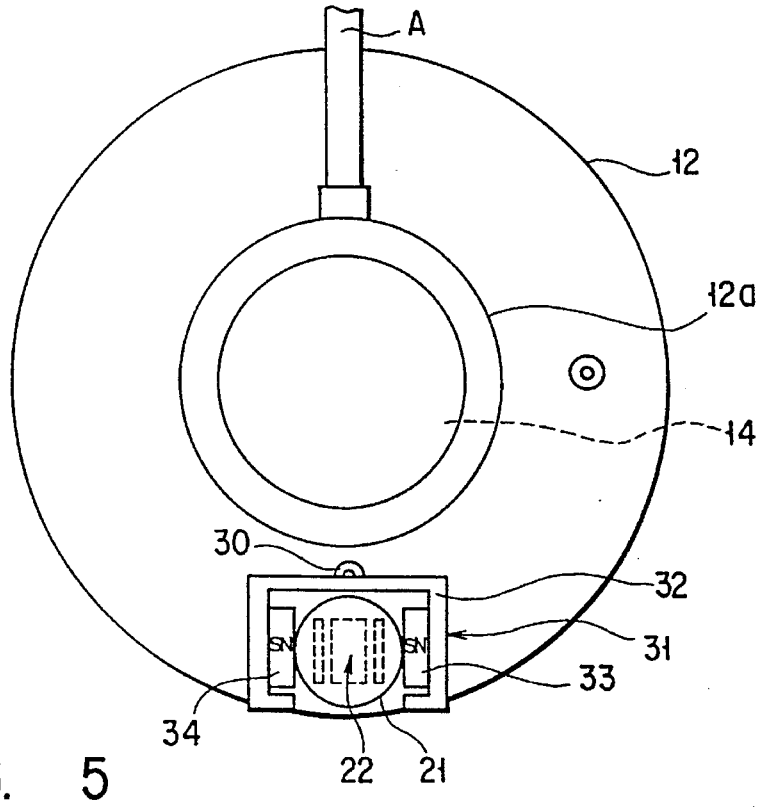
FIG. 5 is a side view showing an output screen side of the X-ray image intensifier shown in FIG. 3.

As shown in FIG. 5, a magnetic device 31 is formed outside the projecting glass tube 21 incorporating the ion pump, so as to apply a DC magnetic field to a space formed between the electrodes 27 and 28 of the ion pump. The magnetic device 31 has a box type magnetic shield 32 formed of a ferromagnetic material (e.g., iron), in which a pair of rectangular parallelopiped permanent magnets 33 and 34 are arranged on the inner sides of two opposed surfaces. These permanent magnets provide a magnetic field perpendicular to the surface of the cathode 27. The box type magnetic shield 32 is arranged so as to completely surround an acceleration anode side of the projecting glass tube 21, so that a magnetic field leak may not be applied particularly to the electron lens region of the image intensifier. The magnetic device 31 is fixed to a wall of the projecting glass tube by an adhesive made of insulating resin (not shown).

when the X-ray image intensifier is operated, an operating power source (not shown) supplies potentials to the above elements: for example, a ground potential E to the input window 11 and the input screen 13, +300 V to a first focusing electrode 15, +1.7 kV to a second focusing electrode, and +30 kV to the output screen 14 and the accelerating anode 18 via a terminal A. As a result, upon operation of the image intensifier, the potential of +1.7 kV, i.e., the voltage of the second focusing electrode 16, is directly applied across the opposed electrodes 27 and 18 of the ion pump 22, so as to perform a gas absorbing function. More specifically, electrons, derived from the titanium cathode 27 and making spiral motion, collide with gas molecules, thereby producing ions. The ions collide with the titanium cathode 27 and cause sputtering, whereby titanium atoms are deposited on an anode plate. The gas absorbing function is continued by a reaction of the gas molecules and the titanium atoms.

In the image intensifier of the above embodiment, an additional power source for the ion pump is not required, the high vacuum state inside the vessel is maintained for a long period of time, and a stable operation without a discharge is maintained. Further, the embodiment requires only one through terminal for applying a voltage to the ion pump. The structure of the image intensifier can be thus simplified.

Figure 8:
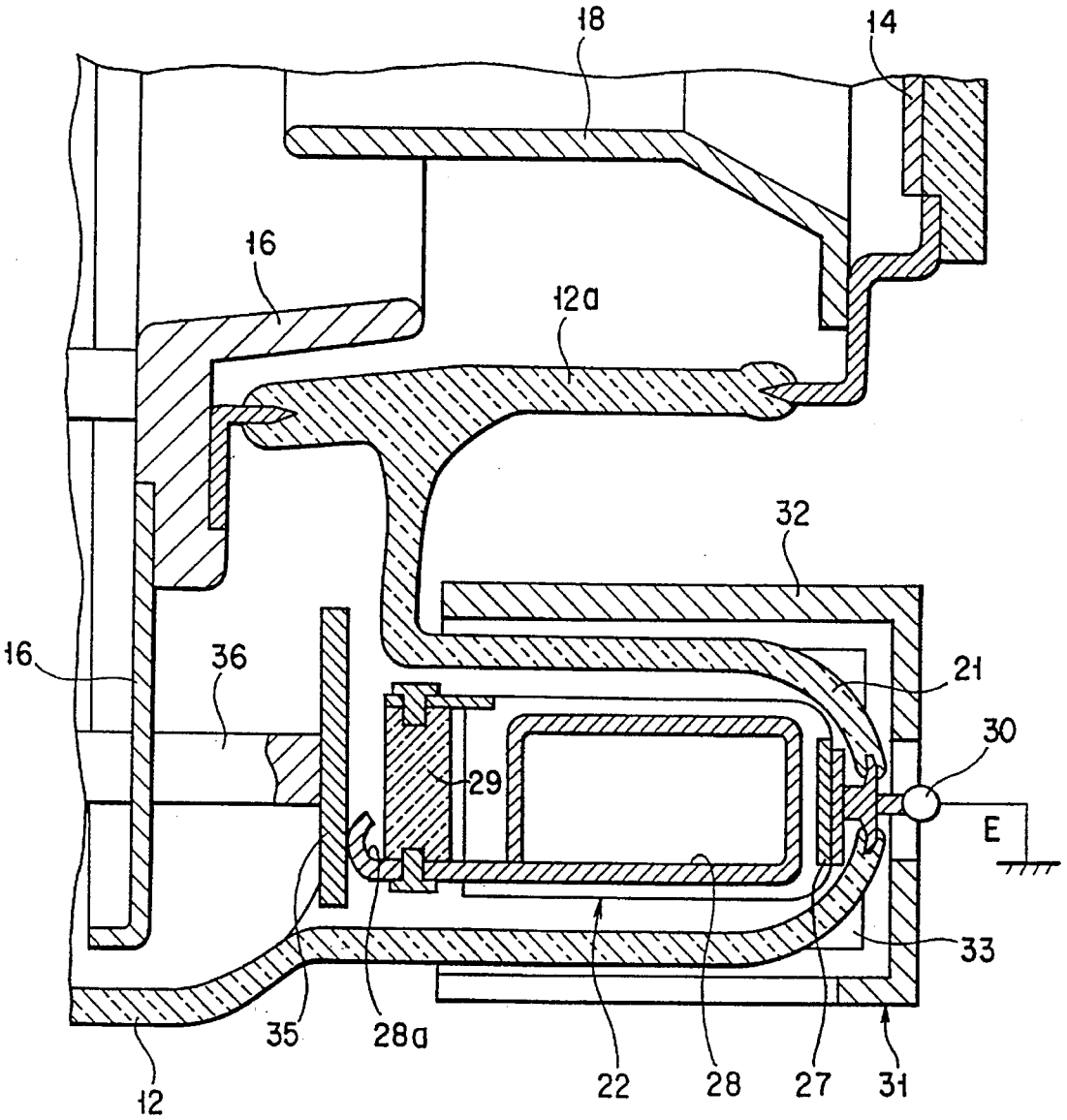
FIG. 8 is a longitudinal cross-sectional view showing part of an X-ray image intensifier according to another embodiment of the present invention.

FIG. 8 shows another embodiment of the present invention, in which a through terminal 30, provided at an end portion of a projecting glass tube 21, is connected to the ground E, and is mechanically and electrically connected to a titanium cathode 27 of an ion pump 22. An internal magnetic shield plate 35 formed of a ferromagnetic material is electrically and mechanically connected by means of a support 36 made of a conductive material to a portion of the second focusing electrode 16 on that side which is opposed to the ion pump. The internal magnetic shield plate 35 is arranged near the ion pump 22. An ion pump anode 28 made of stainless steel is mechanically fixed to the titanium cathode 27 of the ion pump via an insulating spacer 29. A spring-like distal end 28*a* of the ion pump anode 28 is brought into contact with the internal magnetic shield plate 35 and electrically short-circuited with a second focusing lens 16.

In this embodiment, since most of the lines of the magnetic force generated from the magnetic device 31 toward the vessel are collected by the internal magnetic shield plate 35, the region of the electrostatic electronic lens is further prevented from being influenced by the lines of the magnetic force.

Figure 9:
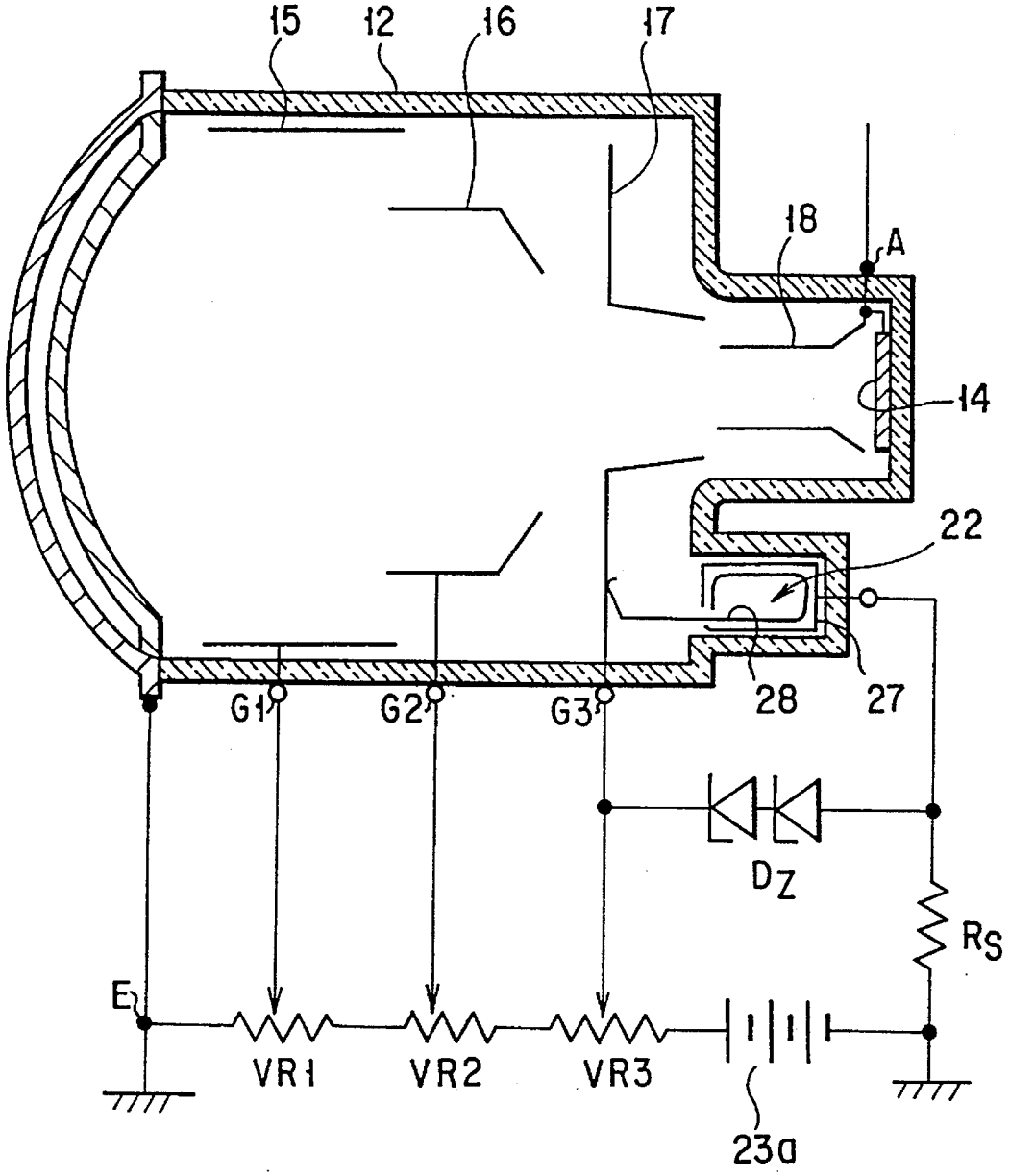
FIG. 9 is a cross-sectional view schematically showing an X-ray image intensifier according to still another embodiment of the present invention.

FIG. 9 shows a still another embodiment of the X-ray image intensifier, in which a voltage applied to focusing electrodes is variable, so that a reduction ratio of an image on an output screen is variable. This X-ray image intensifier has three focusing electrodes. A focusing voltage source 23*a* provides, through potential dividing variable resistors VR1, VR2 and VR3, a voltage of +100 to +130 V to a first focusing electrode 15 through a terminal G1, a voltage of +600 to +900 V to a second focusing electrode 16 through a terminal G2, and a voltage of +4 to +12 kV to a third focusing electrode 17 through a terminal G3, so that the magnifying power of the electronic lens can be changed, thereby changing the reduction ratio of an image formed on the output screen.

An anode 28 of an ion pump 22 is directly connected to the third focusing electrode 17 in the vessel. The cathode 27 is connected to a negative electrode of the focusing voltage source 23*a* through a potential dividing resistor R provided outside the vessel and is also grounded. A voltage regulator diode Dz is connected in parallel between the terminal G3 of the third focusing electrode 17 and a terminal of the cathode of the ion pump. The ends of the voltage regulator diode Dz are set to a constant voltage of about 2 kV.

With the structure of this embodiment, the constant voltage of about 2 kV is applied across the opposed electrodes of the ion pump in the vessel upon operation of the image intensifier, so that a normal operation of the ion pump can be maintained, irrespective of a variable voltage applied to the third focusing electrode 17. If the variable voltage of the third focusing electrode 17 is kept in a range of the voltage applied across the opposed electrodes of the ion pump 22, as required for a normal ion pumping operation, the voltage regulator diode Dz need not be provided.

Figure 10:
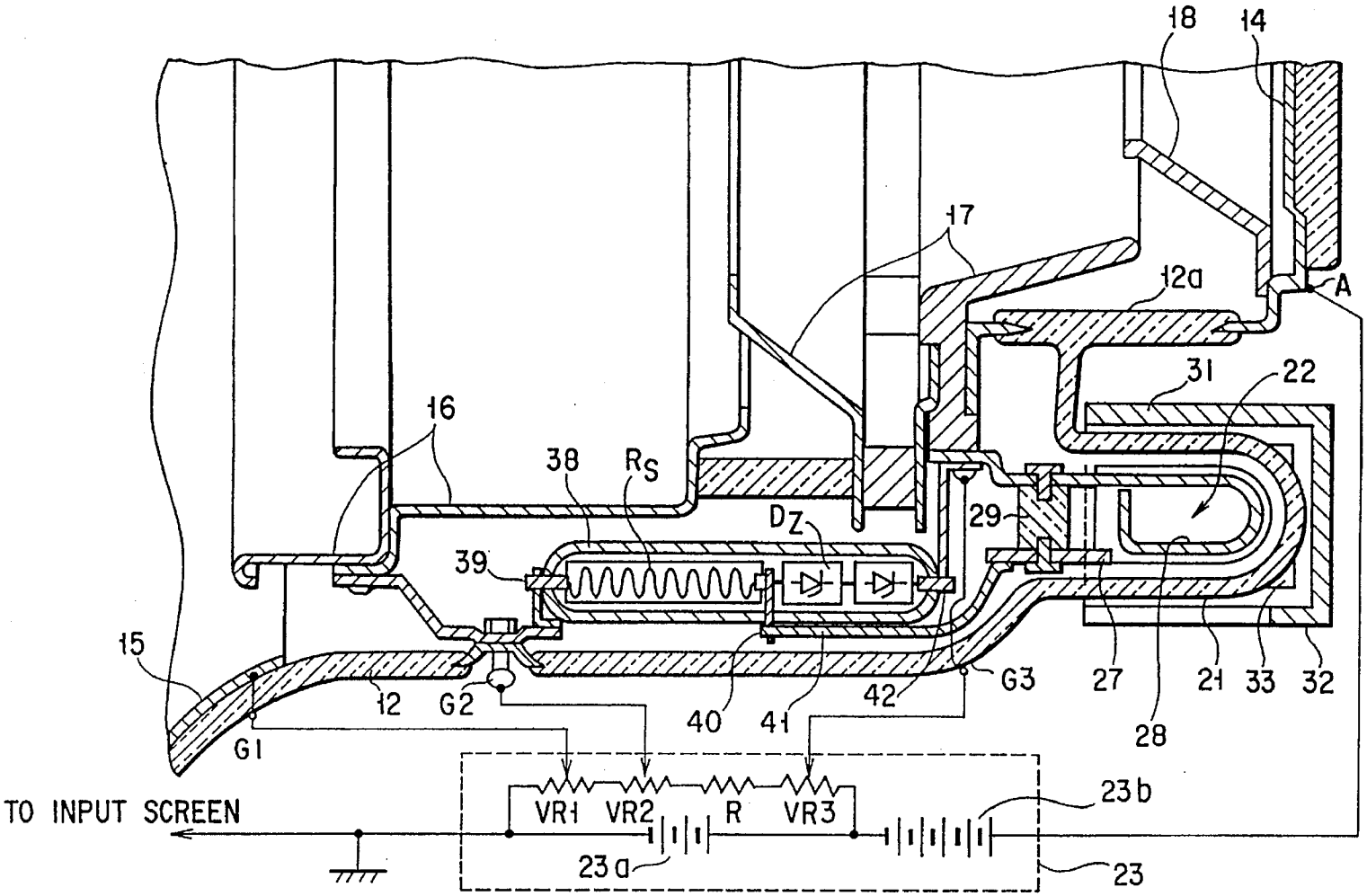
FIG. 10 is a longitudinal cross-sectional view showing part of an X-ray image intensifier according to a further embodiment of the present invention.

FIG. 10 shows a further embodiment the image intensifier of the present invention, which has first to third focusing electrodes 15, 16 and 17 and operation voltages applied thereto are variable, as in the embodiment shown in FIG. 9. The image intensifier incorporates a voltage regulator diode Dz and a potential dividing resistor element Rs, so that a suitable constant voltage can be directly applied to an ion pump 22 in the vessel.

For the above purpose, the voltage regulator diode Dz and the potential dividing resistor element Rs are sealed airtight within a glass or ceramic pipe 38, so that gas generated from the diode or the resistor elements may not be introduced into a space in the vacuum vessel. The pipe 38 is arranged in a space around the periphery of the second and third focusing electrodes 16 and 17. An end of the potential dividing resistor element Rs, i.e., a lead terminal 39, is connected to a terminal G2 of the second focusing electrode 16. A lead terminal 40 is connected to a node between the other end of the potential dividing resistor element Rs and an end of the voltage regulator diode Dz. The lead terminal is connected to the titanium cathode 27 of the ion pump 22 through a lead line 41. The other end of the voltage regulator diode Dz is connected to a lead terminal 42, which is connected to the third focusing electrode 17. An anode 28 of the ion pump 22 is connected to the third focusing electrode 17 in the vessel. An operating voltage is applied to the anode 28 from a potential dividing variable resistor VR3 of the focusing voltage source 23*a* via a through terminal G3. Therefore, the voltage between the second and third focusing electrodes is divided by a serial circuit comprised of the voltage regulator diode Dz and the potential dividing resistor element Rs, with the result that a constant voltage of about 2 kV is directly applied across the opposed electrodes 27 and 28 of the ion pump.

With the structure of the above embodiment, since the operating voltage is applied directly to the ion pump from the focusing electrode, a through terminal only for supplying a voltage to the ion pump need not be provided in the ion pump. The structure of the image intensifier is thus simplified.

In the above embodiments, since a current flowing through the ion pump is at most about 10 μA, an undesirable change in the operating voltage of the focusing electrodes electrically connected to the ion pump, does not occur. Hence, the operation of the image intensifier is not adversely affected at all.

As has been described above, according to the present invention, the ion pump incorporated in the vacuum vessel is operated as soon as the image intensifier starts operating, and absorbs gas generated in the vessel. Hence, the vessel is kept in a high degree of vacuum and discharge is suppressed, so that a stable operation can be maintained. In addition, since number of terminals for applying a voltage to the ion pump are decreased, the structure can be simplified and the image intensifier can be assembled easily.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An X-ray image intensifier comprising:

a vacuum vessel;

first generating means, provided in the vacuum vessel, for generating an electronic image based on an input X-ray image;

second generating means, opposed to the first generating means in the vacuum vessel, for generating an output image based on the electronic image projected thereto;

accelerating means for accelerating the electronic image from the first generating means toward the second generating means;

focusing means, arranged between the first and second generating means in the vacuum vessel, for focusing the electronic image upon the second generating means; and pumping means, incorporated in the vacuum vessel, for pumping gas ions generated in the vacuum vessel, the pumping means comprising:

an electrode structure having an electrical insulating member, a first electrode and a second electrode, the first and second electrodes opposing each other and being electrically separated by the electrical insulating member, the insulating member supporting the second electrode;

means for generating a magnetic field in an area between the first and second electrodes; and a terminal fixed to the vessel, wherein the first electrode is fixed to the terminal and the insulating member, and the second electrode has one end electrically connected to the focusing means in the vacuum vessel.

2. The X-ray image intensifier according to claim 1, further comprising:

means for changing a voltage applied to the focusing means, thereby changing a reduction ratio of the output image formed on the second generating means; and constant voltage means for maintaining a constant voltage, the constant voltage means being electrically connected between the focusing means to which the second electrode is connected and the first electrode.

3. The X-ray image intensifier according to claim 2, wherein the constant voltage means is located in the vessel.

4. The X-ray image intensifier according to claim 1, wherein one of the first and second electrodes of the pumping means is formed of titanium.

5. The X-ray image intensifier according to claim 1, wherein the terminal of the pumping means is embedded in the vacuum vessel.

6. The X-ray image intensifier according to claim 1, wherein the pumping means is supported within the vacuum vessel.

7. An X-ray image intensifier comprising:

a vacuum vessel;

first generator, provided in the vacuum vessel, generating an electronic image based on an input X-ray image;

second generator, opposed to the first generator in the vacuum vessel, generating an output image based on the electronic image;

an accelerator accelerating the electronic image from the first generator toward the second generator;

a focusing device, arranged between the first and second generator in the vacuum vessel, focusing the electronic image upon the second generator; and a pump, incorporated in the vacuum vessel, pumping gas ions generated in the vacuum vessel, the pump comprising:

an electrode structure having an electrical insulating member, a first electrode and a second electrode, the first and second electrodes opposing each other and being electrically separated by the electrical insulating member, the insulating member supporting the second electrode;

a device generating a magnetic field in an area between the first and second electrodes; and a terminal that is fixed to the vessel, wherein the first electrode is fixed to the terminal and the insulating member, and the second electrode has one end electrically connected to the focusing device in the vacuum vessel.

8. The X-ray image intensifier according to claim 7, further comprising:

a device that changes a voltage applied to the focusing device, thereby changing a reduction ratio of the output image formed on the second generator; and a constant voltage device that maintains a constant voltage, the constant voltage device being electrically connected between the focusing device to which the second electrode is connected and the first electrode.

9. The X-ray image intensifier according to claim 8, wherein the constant voltage device is located in the vacuum vessel.

10. The X-ray image intensifier according to claim 7, wherein one of the first and second electrodes of the pumping device is formed of titanium.

11. The X-ray image intensifier according to claim 7, wherein the terminal of the pump is embedded in the vacuum vessel.

12. The X-ray image intensifier according to claim 7, wherein the pump is supported within the vacuum vessel.

* * * * *